US008365964B2

(12) United States Patent
Federighi

(10) Patent No.: US 8,365,964 B2
(45) Date of Patent: Feb. 5, 2013

(54) AERATING POURING SPOUT WITH AUTOMATIC CLOSURE

(76) Inventor: William Federighi, Novato, CA (US)

( * ) Notice: Subject to any disclaimer, the term of this patent is extended or adjusted under 35 U.S.C. 154(b) by 0 days.

(21) Appl. No.: 13/312,813

(22) Filed: Dec. 6, 2011

(65) Prior Publication Data

US 2012/0074172 A1 Mar. 29, 2012

Related U.S. Application Data

(63) Continuation-in-part of application No. 12/653,848, filed on Dec. 18, 2009.

(51) Int. Cl.

| | |
|---|---|
| ***B67D 7/76*** | (2010.01) |
| ***B67D 3/00*** | (2006.01) |
| ***B65D 5/72*** | (2006.01) |
| ***B65D 25/40*** | (2006.01) |
| ***B65D 35/38*** | (2006.01) |
| ***B01F 3/04*** | (2006.01) |

(52) U.S. Cl. ..... 222/190; 222/481.5; 222/500; 222/567; 261/76; 261/DIG. 75

(58) Field of Classification Search ..... 222/463, 222/478, 500, 196.1, 196.2
See application file for complete search history.

(56) References Cited

U.S. PATENT DOCUMENTS

| | | | | | |
|---|---|---|---|---|---|
| 330,812 | A | * | 11/1885 | Ward | 222/500 |
| 424,034 | A | * | 3/1890 | Sutton | 222/189.07 |
| 1,164,453 | A | * | 12/1915 | Belles | 222/500 |
| 1,533,582 | A | * | 4/1925 | Di Bernardi | 222/500 |
| 2,628,736 | A | * | 2/1953 | Warneke | 222/500 |
| 2,762,521 | A | * | 9/1956 | Kipp | 222/482 |
| 3,386,626 | A | * | 6/1968 | Kearney | 222/147 |
| 5,799,836 | A | * | 9/1998 | Lee | 222/189.07 |
| 5,961,008 | A | * | 10/1999 | Peckels | 222/477 |

* cited by examiner

*Primary Examiner* — Kevin P Shaver
*Assistant Examiner* — Matthew Lembo
(74) *Attorney, Agent, or Firm* — Howard Cohen

(57) ABSTRACT

A wine pouring spout that aerates the wine pouring therethrough comprises a generally tubular construction with a flow path extending along the axis of the spout. The flow path is provided with a Venturi constriction, and a Venturi intake port delivers ambient air to the low pressure zone of the constriction, as is generally known in the prior art. A closure member is pivotally joined to the spout, with a distal end that rotates to seal the spout outlet, and rotates open as the spout is tipped to a pouring position. A filter is removably secured in the proximal end of the bore in the spout to remove sediment from the wine.

3 Claims, 5 Drawing Sheets

AERATING POURING SPOUT WITH AUTOMATIC CLOSURE

CROSS-REFERENCE TO RELATED APPLICATIONS

This application is a continuation-in-part of Ser. No. 12/653,848, filed Dec. 18, 2009, for which priority is claimed.

FEDERALLY SPONSORED RESEARCH

Not applicable.

SEQUENCE LISTING, ETC ON CD

Not applicable.

BACKGROUND OF THE INVENTION

1. Field of the Invention

The present invention relates to a pourer for simultaneously pouring liquid from a container and mixing air into the liquid. In particular, the pourer may be used for simultaneously pouring wine from a bottle and decanting the wine.

2. Description of Related Art

Typically, wine is decanted by pouring wine from a bottle into a decanter, Typically, the decanter is placed on a table, and the wine is poured from a distance of approximately 10-20 cm above the top of the decanter, so as to aerate and oxidize the wine on its trajectory from the outlet of the bottle neck to the inlet of the decanter. Or, wine is poured directly into wine glasses, from which it is quaffed by the consumer.

It is considered desirable for wine, red wine in particular, to "breathe" one hour or so before being consumed. It is known that some tannin compounds become oxidized by exposure to air and lose their bitter or stringent tastes, creating a more mellow wine and enabling the perception of flavors that otherwise would be masked. The use of a decanter facilitates that process, but it still requires some latent time before the wine should be consumed.

In order to facilitate pouring of wine out of the bottle and to prevent droplets of wine from being spilled when stopping or interrupting pouring, various wine pourers have been suggested in the prior art. And there is known in the prior art at least one wine pouring spout that attempts to aerate the wine as it is discharged from the bottle through the spout. For example, U.S. Pat. No. 6,568,660 describes a pouring spout that has one end adapted to fit into the opening of a wine bottle and a flow path extending directly therethrough. The flow path is provided with a Venturi constriction at a medial portion thereof, and an air intake port delivers ambient air to the low pressure zone of the Venturi constriction.

Although this prior art device appears effective in the patent description, the real-world device suffers from a fundamental drawback: it fails to draw sufficient ambient air to actually introduce air bubbles into the fluid stream and achieve aeration. In this sense it is a complete failure. Thus there is a need in the prior art for a wine pouring spout that aerates the wine thoroughly and effectively as it is poured through the spout.

BRIEF SUMMARY OF THE INVENTION

The present invention generally comprises a wine pouring spout that is improved to aerate the wine pouring therethrough in an efficient and thorough manner.

In one aspect the pouring spout comprises a generally tubular construction with a flow path extending along the axis of the spout. The flow path is provided with a Venturi constriction, and a Venturi intake port delivers ambient air to the low pressure zone of the constriction, as is generally known in the prior art. A salient aspect of the invention is the provision of a separate displacement air intake channel to feed displacement air into the interior of the wine bottle, so that wine discharged from the spout is replaced by an equal volume of displacement air. In this manner the pouring spout maintains ambient air pressure inside the wine bottle, which enables the Venturi constriction to function properly and draw in ambient air to the wine stream through the Venturi intake port.

The displacement air intake channel may be comprised of a narrow tube extending from the proximal end of the wine pouring spout into the neck of the bottle when the spout is secured in the bottle opening. The narrow tube in cross-section has a convex surface that subtends a small portion of the bottle neck's interior surface, and a secant surface that spans the convex surface. The narrow tube has a hollow central flow space that is open at the proximal end and is connected at the distal end to a displacement air intake at the exterior surface of the wine pouring spout.

In a further aspect the Venturi intake port is comprised of a bore extending generally perpendicularly to the liquid flow path at the Venturi constriction. A salient feature of this arrangement is that a Venturi jet bushing is secured within the Venturi intake bore and provided with a jet passage that admits ambient air into the low pressure zone through the restricted flow space of the jet. Moreover, the jet bushing includes an interior end surface that is recessed from the adjacent surface of the Venturi constriction, which aids in drawing air into the fluid flow through the Venturi constriction.

Another important aspect of the invention is the location of the Venturi intake port in a position adjacent to the displacement air intake at an exterior surface portion of the pouring spout. A hooded rectangular housing is disposed at the exterior surface portion and is provided with a distal opening for the free flow of ambient air therethrough. The housing has an outer wall, sidewalls, and an end wall that enclose the space about the exterior surface portion. As a result, the housing serves two distinct purposes: it directs ambient air to the Venturi intake port as well as the displacement air intake; and it catches any wine drops that may escape from the Venturi intake port. Since the wine bottle is usually upright, these drops will flow gravitally in the housing and enter the displacement air intake, and directed by the displacement air channel back into the interior of the bottle. Thus the displacement air channel also serves two distinct purposes: supplying air to replace wine discharged from the spout, and catching any errant wine drops from the spout.

In a further aspect, the invention provides a closure assembly that seals the pour spout outlet when the bottle in which the spout is installed is oriented in an upright position. The closure assembly includes a projection extending outwardly from the spout adjacent to the outlet opening, and a closure member that is pivotally mounted on the projection. The closure member includes a distal end having an oval shape plate that is dimensioned to equal the outlet opening, and a proximal end that forms a loop extending about a medial portion of the spout. The two ends extend generally transversely each to the other and join at a midpoint where a pivot shaft extends therethrough and through the projection, whereby the closure member pivots about the shaft. The proximal end serves as a counterweight, securing the distal end at the outlet opening when the device is upright. As the device is tipped for pouring from a bottle, the counterweight establishes an equilibrium angle for the closure member, and when the bottle is tipped further the spout outlet opening is uncovered for pouring a liquid therefrom.

DETAILED DESCRIPTION OF THE INVENTION

Figure 1:
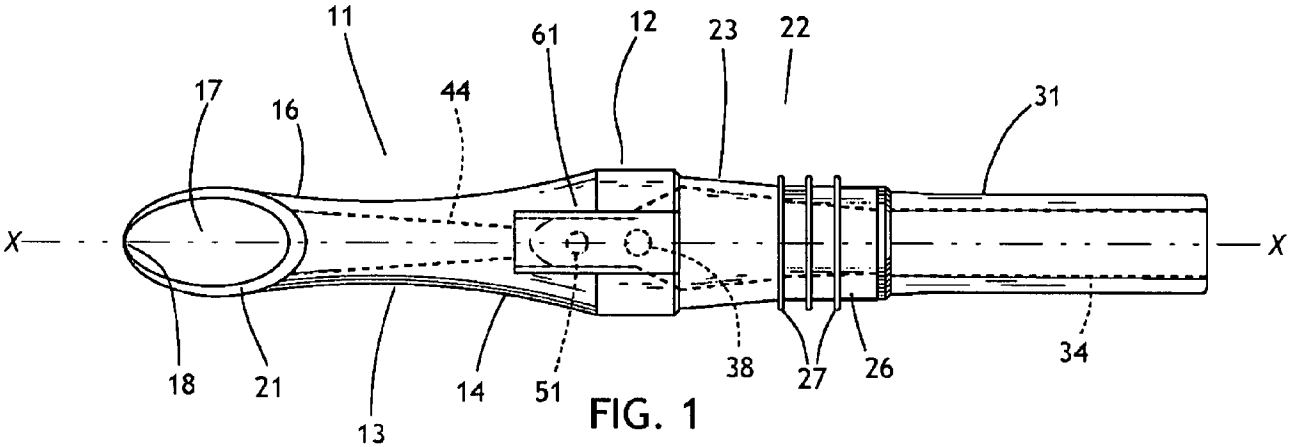
FIG. 1 is a plan view of the wine pouring and aerating spout of the present invention.
Figure 2:
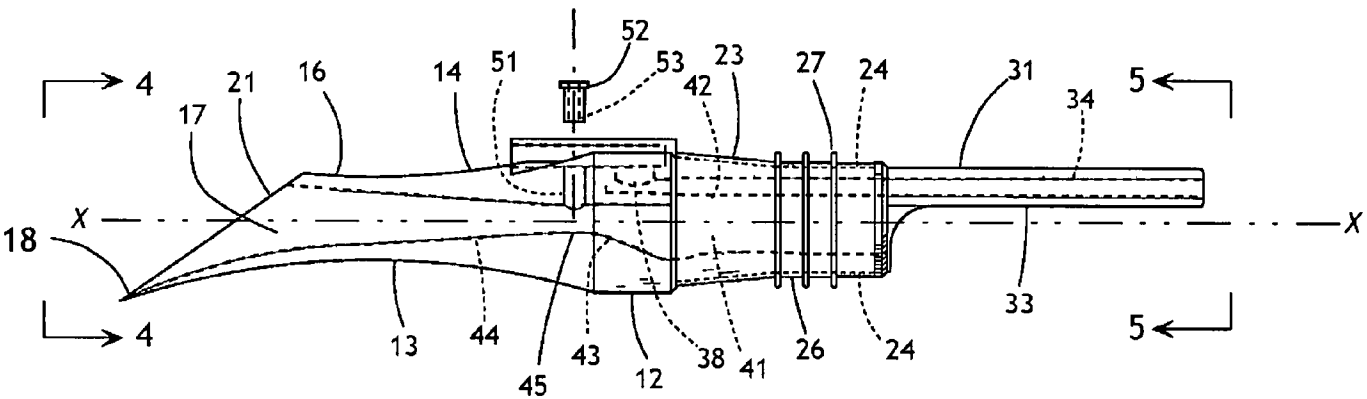
FIG. 2 is a partially exploded side elevation of the wine pouring and aerating spout of FIG. 1.

The present invention generally comprises a wine pouring spout that is improved to aerate the wine pouring therethrough in an efficient and thorough manner. With regard to FIGS. 1-3, the wine pouring spout 11 is comprised of a generally tubular construction having a cylindrical midsection 12 and a distal end portion 13 extending axially therefrom along axis X. The distal portion 13 includes a distally tapering section 14 leading to a midpoint, and a flared section 16 extending distally therefrom, all in smoothly radiused transitions. The distal end of section 16 is a planar truncation 21 extending obliquely to intersect the axis X, and a discharge opening 17 is formed in the truncated end, defining therewith a sharp drip edge 18.

The spout 11 also includes a proximal end portion 22 extending axially from the midsection 12 as a tapering conical section 23 leading to a cylindrical portion 24, all aligned axially. A sleeve-like bushing 26 is formed of a resilient elastomeric material and is dimensioned to be received about the cylindrical portion 24. The outer surface of bushing 26 is provided with one or more annular ribs 27. The outer diameter of the ribs is slightly greater than the inner diameter of a standard wine bottle opening, and the resilient material is capable of compressing elastically and forming a resilient, force-fit, leak-proof seal when inserted in the opening of a wine bottle. The tapered section 23 also aids in providing a resilient sealing engagement in the mouth of a typical wine bottle or the like. Thus the pouring spout assembly 11 is self-retaining in the mouth of a typical wine bottle, and easily placed therein and removed therefrom by manual effort.

Figure 3:
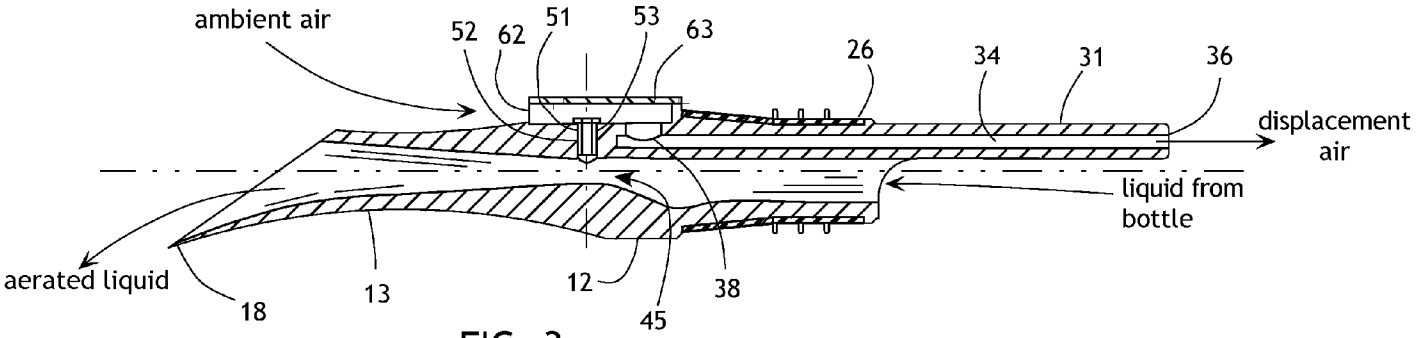
FIG. 3 is a cross-sectional side elevation of the wine pouring and aerating spout of FIGS. 1 and 2.
Figure 5:
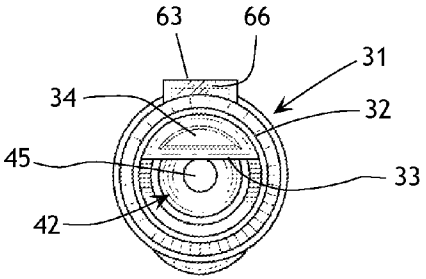
FIG. 5 is a proximal end view of the wine pouring and aerating spout of the invention, taken along line 5-5 of FIG. 1.
Figure 4:
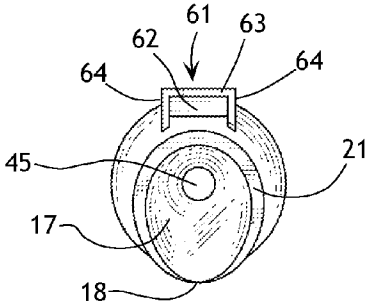
FIG. 4 is a distal end view of the wine pouring and aerating spout of the invention, taken along line 4-4 of FIG. 1.

The spout assembly 11 further includes a displacement air tube 31 extending proximally from the end of section 26 and disposed parallel to and radially offset from the axis X. With regard to FIG. 5, the narrow tube 31 in cross-section has a convex surface 32 that subtends a small portion of the bottle neck's interior surface and is complementary to the curvature of that interior surface. A secant surface 33 spans the convex surface 32 and defines a hollow central flow space 34 that extends longitudinally and is open at the proximal end 36 (FIG. 3). At the distal end the flow space 34 is connected to a displacement air intake 38 extending out of the midsection 12 of the spout assembly 11. Thus when the spout 11 is placed in the opening of a wine bottle there is an unobstructed airflow path from the exterior of the spout assembly 11 to the interior of the wine bottle.

A significant feature of the spout assembly 11 is a bore 41 extending generally axially therethrough. The bore 41 includes a proximal portion 42 extending through sections 23 and 24 of the spout assembly, the portion 42 being substantially cylindrical except for the presence of the secant surface 33 which reduces the flow space of the bore to a small extent. The portion 43 of the bore extends through the midsection 12 and tapers sharply in the distal direction to form a Venturi constriction 45 having a flow space approximately 1/10 of the bore portion 42. In accordance with the observations of Venturi and the equations developed by Bernoulli, the pressure of the liquid flowing through the Venturi constriction 45 is substantially reduced in a direction perpendicular to the liquid flow. In the portion 13 of the spout assembly 11, the bore portion 44 flares distally from the narrow constriction of the Venturi throat 45 to the distal discharge opening 17. Note that the surface of bore portion 44 intersects both the truncation plane 21 and the exterior surface of portion 13 at the distal tip 18 to form a sharp pouring edge that tends not to retain a drop of liquid when the pouring stops.

The spout assembly 11 also provides a Venturi intake port 51 extending from a point slightly downstream (distal) of the Venturi throat 45, to the exterior of the spout assembly. Thus an airstream is introduced to the low pressure zone at the Venturi constriction 45 to aerate the liquid flowing therethrough. In addition, the invention provides a Venturi jet bushing 52 (see FIGS. 2 and 3) that is press fit into the port 51 and is provided with a narrow diameter jet opening 53 that delivers and directs a high velocity air jet at the liquid flowing past the port 51. Note that as shown in FIG. 3, the jet bushing 52 is slightly shorter than the length of port 51, so that there is a small distance between the inner end of the bushing 52 and the sidewall of the Venturi throat 45. This space appears to be an important factor in creating air bubbles in the liquid stream flowing through the bore.

Another important aspect of the invention is the location of the Venturi intake port 51 in a position longitudinally adjacent to the displacement air intake 38 at an exterior surface portion of the pouring spout. A hooded rectangular housing 61 is disposed at the exterior surface portion and is provided with a distal opening 62 for the free flow of ambient air therethrough. The housing has an outer wall 63, parallel sidewalls 64, and a proximal end wall 66 that enclose the space about the exterior surface portion. The housing 61 is designed synergistically to serve two distinct purposes: it directs ambient air to the Venturi intake port 51 as well as the displacement air intake 38; and it catches any wine drops that, in an unlikely event, may escape from the Venturi intake port. Note that when the pour spout 11 is installed in a wine bottle opening, the distal end of the spout extends upwardly and the distal opening 62 also opens upwardly, and any liquid drops retained in the pour spout tend to flow gravitally back into the bottle through passageway 42 or displacement air channel 34.

Figure 6:
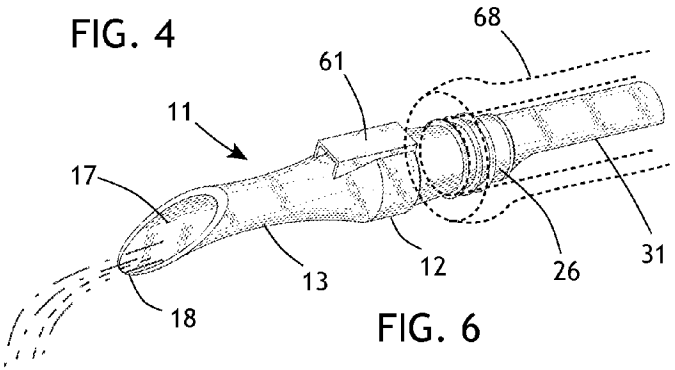
FIG. 6 is a perspective view of the wine pouring and aerating spout of the invention shown in typical use.

The procedure for using the wine pouring spout assembly 11 as described above is simple and effective. Directly after a bottle of wine is opened (e.g., uncorked), the proximal end of the spout assembly 11 is placed into the opening of the bottle, and inserted until the resilient bushing 26 lodges firmly in the mouth of the bottle. The bottle 68 is then tipped, as shown in FIG. 6, causing the liquid in the bottle to flow through the bore passageway 42, the Venturi constriction 45, and through the bore portion 44 to be discharged from the pouring lip 18 of the distal opening 17. With reference to FIG. 3, the volume of wine discharged from the bottle is replaced directly by ambient air flowing through opening 62 into displacement air intake 38, and thence through flow channel 34 into the airspace in the bottle. At the same time, the velocity of the liquid flowing through the Venturi throat 45 creates a low pressure zone therein that induces an air flow through opening 62 and into Venturi intake port 51. The Venturi jet 53 creates a narrow high velocity air stream that produces bubbles in the liquid stream flowing through the Venturi throat, resulting in aerated liquid discharged from the pouring spout through opening 17. The spout directly outflow therefrom very precisely, enabling a host to pour into glasses of any size and shape. Most importantly, there is no need to wait for a good red wine to breathe for an hour or more, when the simple act of pouring that wine produces the aeration that enables the wine to be consumed without delay.

It may be appreciated that the spout assembly may be easily removed from a wine bottle or similar container, washed and rinsed, and re-used indefinitely. It is not intended as a cork replacement for long-term storage of wine after the bottle has been opened.

However, a further embodiment of the invention, shown in FIGS. 7-13, provides an automatic closure of the spout assembly when the bottle is upright, enabling the spout to remain in the bottle and serve as a bottle stopper. The distal portion 13 is provided with a projection 71 extending outwardly therefrom and located directly adjacent to the opening 17 and in general longitudinal alignment with the housing 61. The projection 71 extends generally transversely to the axis X and is sufficient in size and strength to support a pivot shaft 72 extending transversely therethrough. A closure member 73 includes a distal portion 74 that is an oval-shaped plate configured and dimensioned to completely occlude the opening 17 when it impinges on the planar truncation 21 that forms the opening 17. The closure member 73 also includes a proximal end 76 comprising a loop 77 that circumscribes the distal portion 13 of the spout. The loop 77 is joined to two arms 78 that straddle the distal portion 13 of the spout and extend to the distal portion 74 of the closure member. As shown best in FIG. 9, the arms 78 converge slightly from the loop 77 toward the distal portion 74, and curve out of the plane of the distal portion 74, as best shown in FIGS. 10-13, forming an included angle therewith that approaches a right angle. The pivot shaft 72 extends through the closure member adjacent to the conjunction of the proximal and distal portions thereof, whereby the closure member rotates freely about the shaft 72. The masses of the proximal and distal ends 73 and 76 comprise two opposed lever arms joined to form a unified assembly that pivots in seesaw fashion about the shaft 72.

Figure 7:
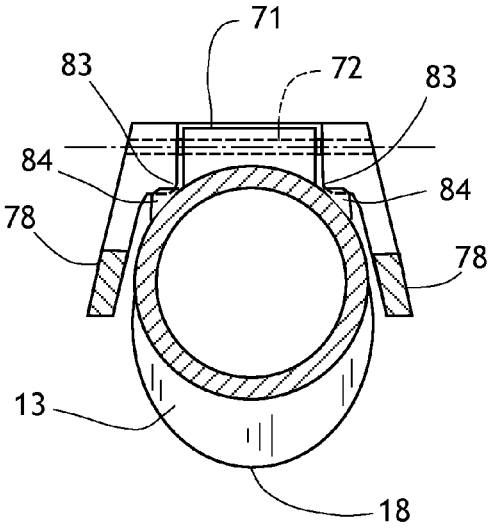
FIG. 7 is a cross-sectional elevation taken along line 7-7 of FIG. 12.
Figure 8:
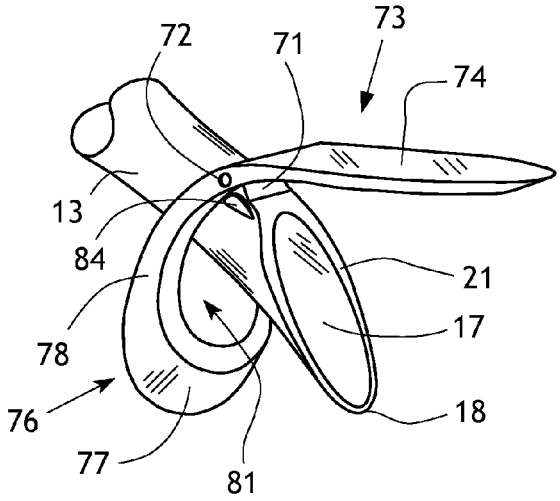
FIG. 8 is a perspective view of a further embodiment of the wine pouring and aerating spout, featuring an automatic closure cap.
Figure 9:
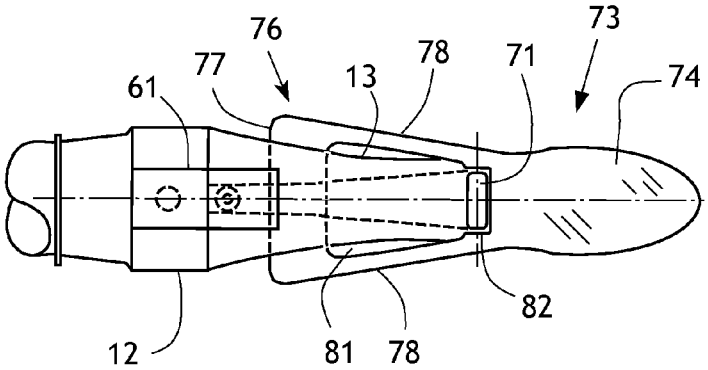
FIG. 9 is a plan layout of the embodiment depicted in FIG. 8.

With regard to FIGS. 7-9, the loop 76 and arms 78 of proximal portion 76 define an opening 81 through which the distal portion 13 of the spout extends. At the distal end of the opening 81 a slot 82 is formed and disposed to receive therein the projection 71 extending from the exterior surface of the spout. A pair of wings 83 are formed in the closure member in bilateral symmetry at either side of the slot 82 where it joins the arms 78. A pair of stop lugs 84 project outwardly from the surface of the spout adjacent to and in bilateral symmetry with the projection 71, as shown in FIGS. 7 and 8. The stop lugs 84 are disposed in the rotational path of the wings 83 to block rotation of the closure member at defined angular orientations of the spout, as described below.

Figure 10:
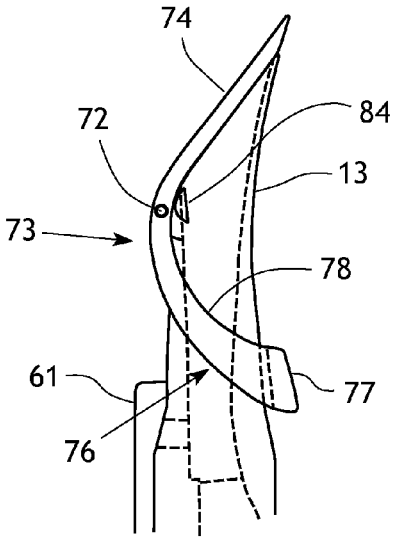
FIGS. 10-13 are a sequence of side views showing the embodiment of FIGS. 8 and 9 in progressively more inclined orientations.
Figure 11:
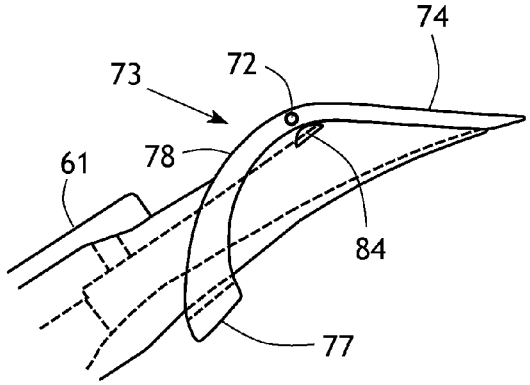

The closure member 73 exhibits a rotational dynamic equilibrium regarding the mass of the closure panel 74 counteracting the mass of the proximal end 73. As a result, the closure member assumes an angular orientation shown in FIG. 12. When the spout 13 is tipped upwardly, the closure member remains at the equilibrium angle while the opening 17 rotates upwardly until it contacts the closure panel 74, as shown in FIG. 11, effectively sealing the outlet opening 17. At any further upward angular orientation the impingement of the closure panel 74 about the opening 17 causes the closure member to remain sealed about the opening 17, so that, as shown in FIG. 10, the spout may extend vertically in a bottle and the opening 17 will remain sealed. Note that in this orientation the loop end 77 of the closure member does not touch or impact on the spout.

Figure 12:
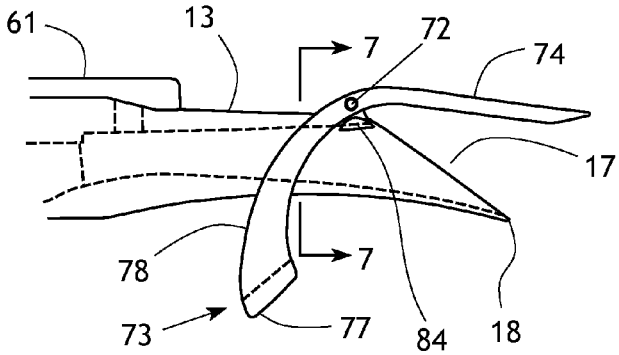
Figure 13:
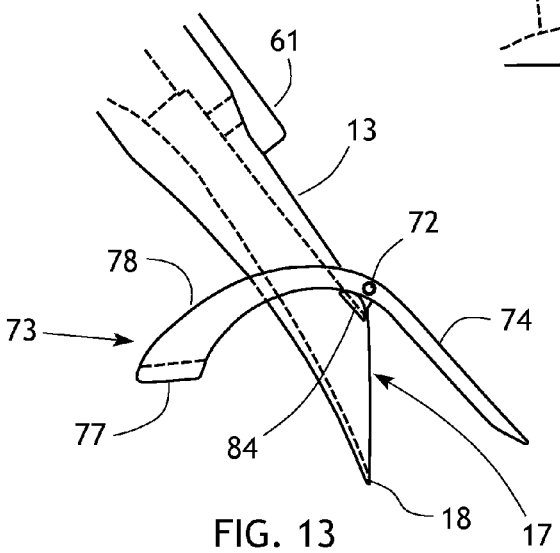
Figure 15:
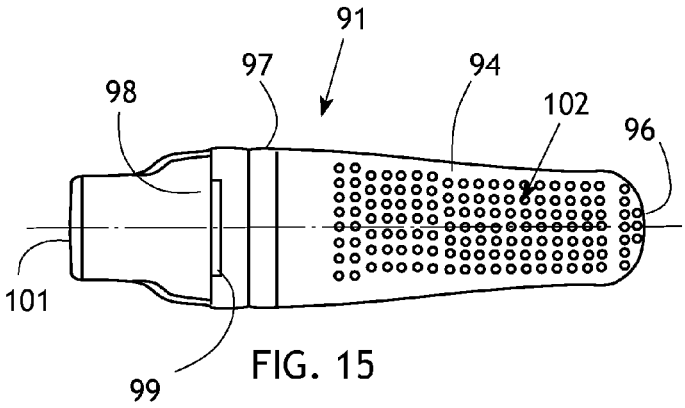
FIGS. 14-16 are orthogonal projection views of a further embodiment of the invention for capturing sediment in the liquid poured through the invention.
Figure 14:
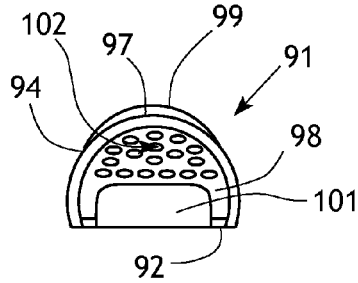
Figure 16:
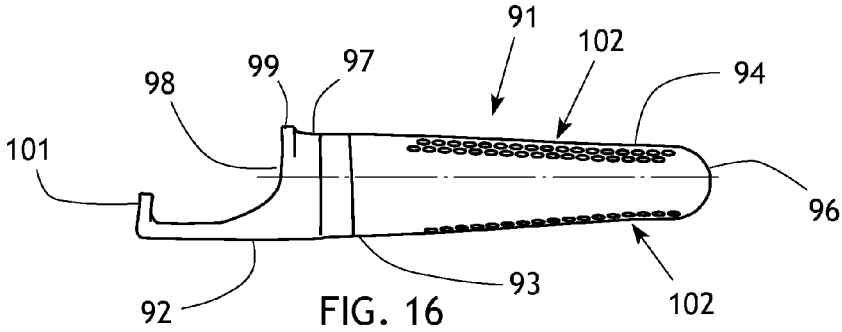

When the spout is tipped at a greater downward angle from the horizontal orientation of FIG. 12 to obliquely downward position of FIG. 13, the stop lugs 84 rotate about shaft 72 until they impinge on the wings 83 of the closure member, as shown in FIG. 13. Beyond this downward angle the stop lugs will continue to engage the wings 83, causing the closure member to be rotated together with the spout to a more downward angle.

For the casual user of the spout, the broadly important factors that are apparent are the spout may remain in the bottle, with the outlet opening sealed by the closure member. When the bottle is tipped to pour wine therefrom, the closure member pivots open "automatically" and allows the wine to be poured freely. When the bottle is again placed upright at rest the closure member again seals the outlet opening.

In a further embodiment of the invention, shown in FIGS. 14-17, a removable wine filter 91 is provided to remove sediment or other particulates from the wine being poured through the spout 11. The filter 91 includes a base panel 92 tapering distally and laterally from an inflection point 93. A closed curved sidewall 94, comprising a section of an oblate surface, extends integrally from the base panel to define a closed curved shape having a rounded distal end 96. The semicircular proximal end 97 of sidewall 94 defines an intake opening 98, and a flange 99 extends outwardly from the sidewall 94 adjacent to the opening 98. A Lip 101 extends from the proximal end of the filter 91 and serves as finger pull to enable removal of filter as described below. A large number of small holes (approx. 1 mm) are formed in arrays 102 in the curved sidewall 94 and the distal portion of the base panel 92 in order to enable liquid (wine) to flow therethrough while sediment and other particulates are blocked by the small diameter holes.

Figure 17:
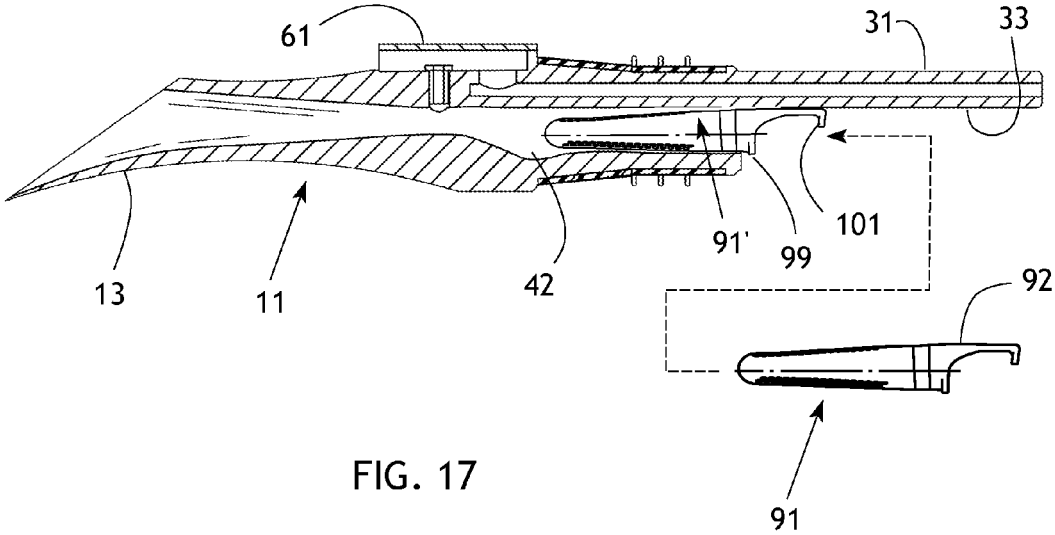
FIG. 17 is an assembly view showing the sediment filter and its position in the pouring and aerating spout.

The filter 91 is dimensioned to be inserted into position 91' in the proximal bore portion 42, as shown in FIG. 17, with the rounded end 96 extending distally and the proximal sidewall portion 97 lodged in the opening of bore portion 42. The flange 99 acts as stop to limit insertion of filter into proximal end 42 of spout bore (FIG. 5), and the base panel 92 impinges fully on the secant surface 33 of displacement air tube 31. The opening 98 receives the full flow of wine from the bottle in which the spout is installed, and the tapering of the distal end of the filter defines a flow space between the filter and the inner bore surface to allow the liquid to flow therethrough, as described previously, to be aerated and discharged while any sediment, cork debris, and the like are retained by the filter 91. The lip 101 provides a convenient point for fingertip engagement to pull the filter out of the bore 42, so that it may be cleaned and reused.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A pouring spout for pouring liquid from a container while simultaneously aerating the liquid discharged from the spout outlet opening and including a tubular body having a liquid flow path extending longitudinally therethrough and a Venturi constriction located in the flow path and a Venturi air intake opening into the Venturi constriction to aerate the liquid as it flows therethrough, the improvement comprising:

a closure member for sealing said outlet opening when said spout is upwardly oriented, said closure member being rotatable to unblock said outlet opening when said spout is tipped to a pouring position, wherein said closure member includes a distal end having a configuration adapted to seal said outlet opening and a proximal end that comprises a counterweight to said distal end in rotation about said pivot shaft, said proximal end includes a loop portion that circumscribes a distal portion of said spout in complementary curved fashion to said distal portion of said spout and is spaced apart therefrom, the closure member further includes a pair of support arms extending from opposed ends of said loop portion to said distal portion of said closure member, said support arms being spaced apart and said distal portion of said spout being disposed between said support arms;

a pivot shaft secured to said tubular body exteriorly of said liquid flow path, said pivot shaft extending from said tubular body to pivotally support said closure member;

stop means for limiting rotation of said closure member about said pivot shaft when said spout is tipped to the pouring position and preventing said closure member from striking said tubular body, said stop means disposed exteriorly of said liquid flow path wherein said stop means includes at least one stop lug extending outwardly from the exterior surface of said distal portion of said spout and disposed in the rotational path of a portion of at least one of said support arms.

2. The pouring and aerating spout of claim 1, wherein said stop means for limiting rotation of said closure member and said pivot shaft are disposed distally of said Venturi constriction in said tubular body.

3. The pouring and aerating spout of claim 1, wherein said liquid flow path includes a proximal intake opening, and further including a filter dimensioned to be removably secured in said proximal intake opening.

* * * * *